US011878844B1

(12) United States Patent
McClain

(10) Patent No.: US 11,878,844 B1
(45) Date of Patent: Jan. 23, 2024

(54) LID FOR COFFEE CUPS

(71) Applicant: Sean McClain, Miami, FL (US)

(72) Inventor: Sean McClain, Miami, FL (US)

( * ) Notice: Subject to any disclaimer, the term of this patent is extended or adjusted under 35 U.S.C. 154(b) by 0 days.

(21) Appl. No.: 18/344,843

(22) Filed: Jun. 29, 2023

(51) Int. Cl.
*B65D 43/06* (2006.01)
*B65D 47/06* (2006.01)

(52) U.S. Cl.
CPC ..... *B65D 43/06* (2013.01); *B65D 47/06* (2013.01)

(58) Field of Classification Search
CPC ..... B65D 51/28; B65D 43/06; B65D 43/08; B65D 43/02; B65D 43/00; B65D 47/06; B65D 47/04; B65D 47/00
See application file for complete search history.

(56) References Cited

U.S. PATENT DOCUMENTS

| | | | | |
|---|---|---|---|---|
| 8,381,935 | B1 * | 2/2013 | Buck | B65D 47/265 220/709 |
| 9,114,920 | B1 * | 8/2015 | Edelman | B65D 51/28 |
| 2016/0114947 | A1 * | 4/2016 | Buck | B65D 51/28 220/713 |
| 2016/0270571 | A1 * | 9/2016 | Wang | A47G 19/2272 |

* cited by examiner

*Primary Examiner* — Javier A Pagan
(74) *Attorney, Agent, or Firm* — Ruben Alcoba, Esq.

(57) ABSTRACT

A lid that is designed to cover the lip of a disposable coffee cup. The lid defines a circular central wall on its top side that is designed to receive a lip of a disposable miniature coffee cup. The lid defines a perforated spout on its top side that opens outward toward the circumference of the lid. The lid is designed to serve as mount, after a first miniature coffee cup is inserted into the circular central wall, that will securely hold a stack of miniature coffee cups.

7 Claims, 3 Drawing Sheets

LID FOR COFFEE CUPS

TECHNICAL FIELD

The present invention pertains to a lid that is used to carry a stack of miniature coffee cups.

BACKGROUND

The inventor of the present invention is an avid Colada (Cuban coffee) drinker.

A Colada normally comes in at least a 4 oz coffee cup and is meant to be shared by a group of coffee drinkers.

Coladas are shared by pouring a large batch of sweet espresso into an at least 4-8 oz coffee cup, then distributed into disposable miniature coffee cups for individual drinking. The miniature coffee cups are normally provided by the establishment serving the coffee.

The inventor of the present invention, amongst many others, occasionally drop the miniature coffee cups while transporting the Colada or while attempting to pour the espresso from the colada into the miniature coffee cup with both hands.

The inventor designed the present invention to leave no chance that the miniature coffee cups would be dropped (can be wind or carelessness) during transport or serving of the Colada.

SUMMARY

The present invention is directed to a lid that is designed to cover the lip of a disposable coffee cup. The lid defines a circular central wall on its top side that is designed to receive a lip of a disposable miniature coffee cup. The lid defines a perforated spout on its top side that opens outward toward the circumference of the lid. The lid is designed to serve as a mount, after a first miniature coffee cup is inserted into the circular central wall, that will securely lock and hold a stack of miniature coffee cups.

An object of the present invention is to provide a lid that will serve as a mount for a stack of miniature coffee cups and seal them in place.

Another object of the present invention is to provide a lid that has a perforated spout that will allow coffee to be served with a minimal drip and without requiring removing the miniature cups from top of lid.

Yet another object of the present invention is to provide a lid that will prevent the inadvertent dropping of miniature coffee cups while carrying the coffee cup that the lid covers.

BRIEF DESCRIPTION OF THE DRAWINGS

These and other features, aspects, and advantages of the present invention will become better understood with regards to the following description, appended claims, and drawings where:

DESCRIPTION

Figure 1:
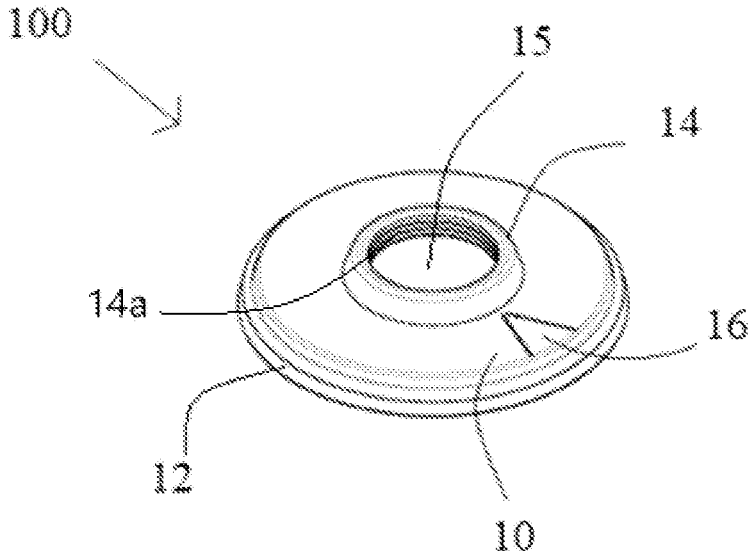
FIG. 1 is a perspective view of the present invention.
Figure 2:
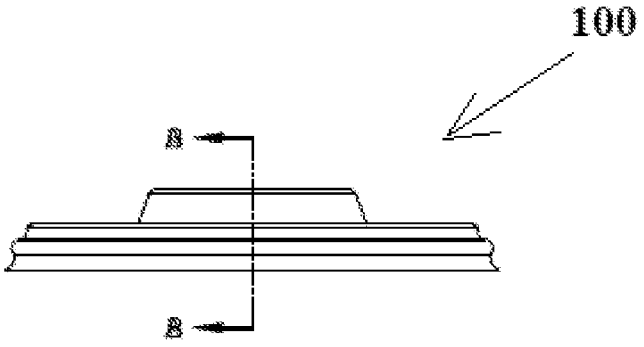
FIG. 2 is a side view of the present invention.
Figure 3:
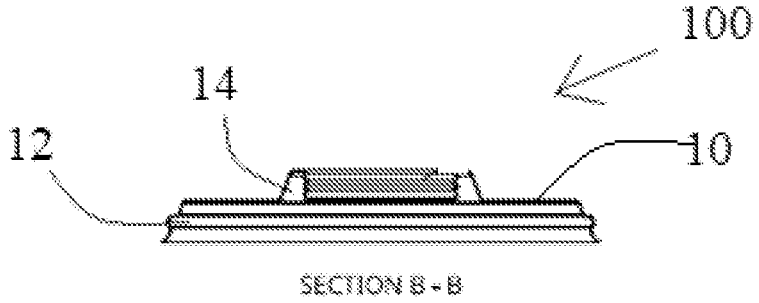
FIG. 3 is a sectional view of the present invention.
Figure 4:
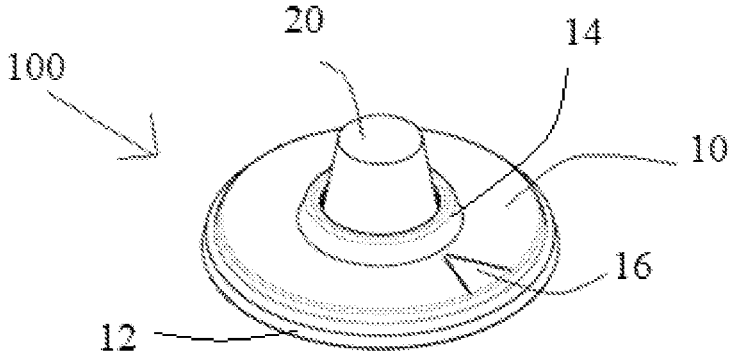
FIG. 4 is a perspective view of the present invention that shows a miniature coffee cup mounted on the lid.
Figure 5:
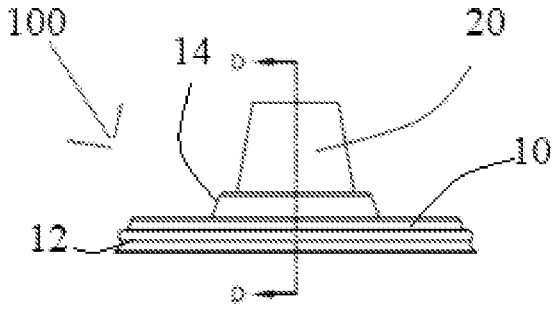
FIG. 5 is a side view of the present invention that shows a stack of cups mounted on the lid.
Figure 6:
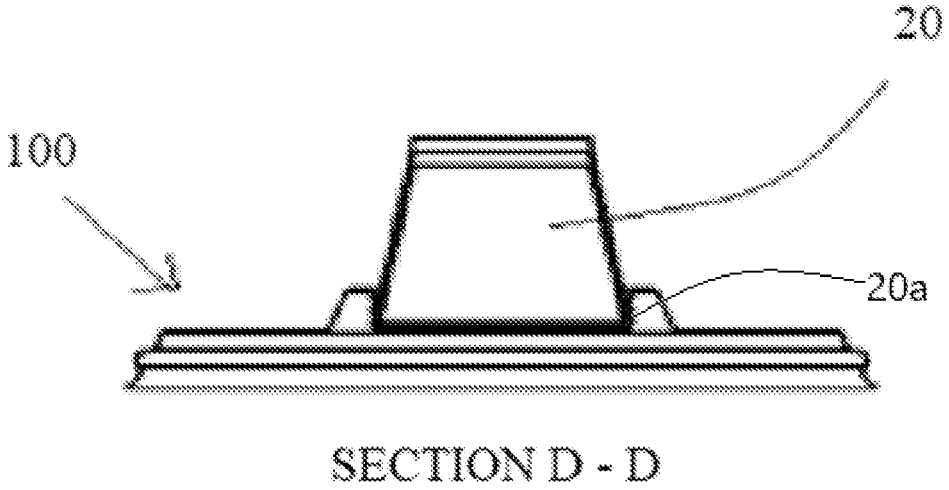
FIG. 6 is a sectional view of the present invention that shows the stack of cups.

As seen in FIGS. 1-6, the present invention is a lid 100 that is designed to cover a disposable coffee cup, the lid comprises a circular planar body 10 that defines a first flexible wall around 12 its circumference that protrudes in a first direction, the first flexible wall is configured to mount on a lip of a disposable coffee cup. A second flexible circular wall 14 is positioned around a central axis 15 of the circular planar body 10 that protrudes in a second direction, the second direction being an opposite direction to the first direction, an inner side 14*a* of the second flexible circular wall 14 defines at least one rib and at least one recess, the at least one rib and the at least on recess alternate, each recess is configured to receive a lip 20*a* of a miniature disposable coffee cup 20. And, a perforated spout 16 that is positioned at a position that is adjacent to the circumference of the circular planar body 10, the perforated spout 16 opens in to the second direction. In a preferred embodiment of the present invention, the invention will be a kit comprising the lid designed to cover the disposable cup of claim 1, the kit comprises a plurality of miniature disposable coffee cups, each of the plurality of miniature disposable coffee cups defines a lip, the lip of each of the plurality of miniature disposable coffee cups is designed to insert into the recesses of the second flexible circular wall.

In an embodiment of the present invention, the lid 100 is made of plastic.

In embodiments of the present invention, the lid 100 has a diameter that is between at least 62 mm and at most 90 mm, and the diameter of the second flexible circular wall 14 is at least 25.4 mm.

In embodiments of the present invention the perforated spout 16 opens toward the circumference of the circular planar body 10.

An advantage of the present invention is that it provides a lid that serves as a mount for a stack of miniature coffee cups.

Another advantage of the present invention is that it provides a lid that has a perforated spout that allows coffee to be served with a minimal drip.

Yet another advantage of the present invention is that it provides a lid that prevents the inadvertent dropping of miniature coffee cups while carrying the coffee cup that the lid covers.

The embodiments of the lid described herein are exemplary and numerous modifications, combinations, variations, and rearrangements can be readily envisioned to achieve an equivalent result, all of which are intended to be embraced within the scope of the appended claims. Further, nothing in the above-provided discussions of the lid should be construed as limiting the invention to an embodiment or a combination of embodiments. The scope of the invention is defined by the description, drawings, and claims.

What is claimed is:

1. A lid designed to cover a disposable coffee cup, the lid comprises:

a circular planar body that defines:

a first flexible wall around its circumference that protrudes in a first direction, the first flexible wall is configured to mount on a lip of a disposable coffee cup;

a second flexible circular wall is positioned around a central axis of the circular planar body that protrudes in a second direction, the second direction being an opposite direction to the first direction, an inner side of the second flexible circular wall defines at least one rib and at least one recess, the at least one rib and the at least on recess alternate, each recess is configured to receive a lip of a miniature disposable coffee cup; and a perforated spout that is positioned at a position that is adjacent to the circumference of the circular body, the perforated spout opens in to the second direction.

2. The lid designed to cover the disposable coffee cup of claim 1, wherein the lid is made of plastic.

3. The lid designed to cover the disposable coffee cup of claim 2, wherein the lid has a diameter that is between at least 62 mm and at most 90 mm.

4. The lid designed to cover the disposable coffee cup of claim 3, wherein the diameter of the second flexible circular wall is at least 25.4 mm.

5. The lid designed to cover the disposable coffee cup of claim 4, wherein the perforated spout opens toward the circumference of the circular planar body.

6. The lid designed to cover the disposable coffee cup of claim 1, wherein the perforated spout opens toward the circumference of the circular planar body.

7. A kit comprising the lid designed to cover the disposable cup of claim 1, the kit comprises a plurality of miniature disposable coffee cups, each of the plurality of miniature disposable coffee cups defines a lip, the lip of each of the plurality of miniature disposable coffee cups is designed to insert into the recesses of the second flexible circular wall.

* * * * *